US005554833A

United States Patent [19]

Johnson

[11] Patent Number: 5,554,833

[45] Date of Patent: Sep. 10, 1996

[54] MAGNETIC SWITCH TRIPPING SYSTEM

[76] Inventor: Wayne Johnson, 2303 Winchester St., Oceanside, Calif. 92054

[21] Appl. No.: 312,526

[22] Filed: Sep. 26, 1994

[51] Int. Cl.[6] ..... H01H 3/16; H01H 9/00

[52] U.S. Cl. ..... 200/61.72; 335/205

[58] Field of Search ..... 200/52, 61.62, 200/61.69, 61.7, 61.71–61.75, 61.76–61.82, 61.93; 335/205–208; 340/545–549, 693

[56] References Cited

U.S. PATENT DOCUMENTS

| | | | |
|---|---|---|---|
| 3,710,369 | 1/1973 | Takahashi | 340/547 |
| 4,057,773 | 11/1977 | Cohen | 335/205 |
| 4,213,110 | 7/1980 | Holce | 335/207 |
| 4,292,629 | 9/1981 | Kerr et al. | 340/547 |
| 4,438,430 | 3/1984 | Young et al. | 340/547 |
| 4,677,424 | 6/1987 | Hollinger | 340/547 |
| 4,990,898 | 2/1991 | Greene | 340/693 |
| 5,416,456 | 5/1995 | Light | 335/205 |

*Primary Examiner*—J. R. Scott

[57] ABSTRACT

For use primarily in sliding glass doors and windows for tripping a magnetic switch embedded in the casing as part of a security alarm circuit, a magnetic switch trip comprises an elongated L-shaped insert having a small bar magnet in one leg, with the other leg comprising a stem extending at a 90° angle from the magnet, there being a narrowed, frangible neck between the stem and the magnetic to permit snapping the magnet off of the stem. The insert is used primarily as a single piece by inserting the magnet leg into a hole in the vertical side panel of a sliding door frame, and rotating the insert inside the door until the magnet is vertical, adjacent the overlying door casing. The stem is then plugged into the hole for a permanent mount. Alternative modes of use accommodate other sliding fixture types, resulting in one device eliminating separate inventory requirements for at least three different elements of the magnetic reed switch sensors.

13 Claims, 1 Drawing Sheet

MAGNETIC SWITCH TRIPPING SYSTEM

BACKGROUND OF THE INVENTION

The invention is in the field of security alarms for entryways and windows and involves a device and technique for using it that is primarily in the realm of the workman/installer.

Burglar alarms typically include long circuits with interruptible switches wired in series, placed at doors and windows throughout the building such that opening any one of them opens the circuit and triggers the alarm. Each entryway of a residence or business building, such as a window, door, or chimney, has at least one the these interruptible elements so that every possible entryway into the building is wired.

Sensor switches on sliding glass doors and windows typically comprise magnetic reed switches. A dowel-shaped switch housing is inserted into a hole drilled up into the top of the casing from underneath so that it is spaced just above the top of the underlying door as the door slides. The switch is installed in the least inaccessible location in the overhead sliding door casing, and then the trip magnet is installed on the top of the door. The magnet is positioned to align with the switch when the door is closed, so that it holds the reed of the magnetic switch in the closed position. Rupture of the line, or the opening of any of the fixtures to which a switch is mounted, interrupts the circuit and actuates the alarm.

Traditionally, the installation of the magnetic trigger on the top of the sliding door has not been a problem because the doors could be slipped off of the their tracks from the outside very easily, and the magnet could be glued to the top of the door between the peripheral sidewalls. It was simple, rugged, inexpensive and straightforward.

This has all changed recently since sliding door designs have been changed to thwart trespassers. Manufactures now making doors that cannot be removed from the outside. The design is so effective that now, what used to be the simple procedure of gluing a magnet on the top of a door, has become a time-consuming project. What used to take several minutes now takes two hours or more. The door has to be dismantled completely, and the glass removed from the frame to provide access to the top of the door beneath the overhead casing. The alternative is put a side-mounted magnet on the door, which is not as attractive and alerts the burglar to the location of the warning device.

Related to the problem of the sliding door that cannot be removed from its tracks is the fact that there are still in existence many of the older door types which can still be removed from their tracks, so that any trip that would work especially well for the new doors but not for the old doors would require a double parts inventory.

There is a need for a system and device for installing a magnet in a modern sliding door which does not require dismantling and reassembly of the door.

SUMMARY OF THE INVENTION

The instant invention fulfills the above-referenced needs by defining a crook-shaped insert magnet assembly which is inserted into a hole drilled into the door frame wall, the configuration of the insert being such that it can be rotated to swing the magnet upright into the proximity of the door casing to be operative with a magnetic reed switch installed therein. The final installation motion pushes the trailing end of the insert into the door frame hole, where it seats snugly and almost invisibly. The insert may have other uses in addition to sliding door alarm switch triggers, but that is the only implementation described.

The preferred form has a weakened central region which can be snapped apart to free the magnetic plug portion, which can then be used upright glued to the top of a door. Alternatively, it can be used as a conventional insert to plug into a 5/16 inch cylindrical hole.

Lastly, in a form of the invention in which a rectangular magnet is used, the magnet can be slipped from its plastic housing and used bare in a minimum clearance sliding window frame.

DETAILED DESCRIPTION OF THE PREFERRED EMBODIMENT

Figure 1:
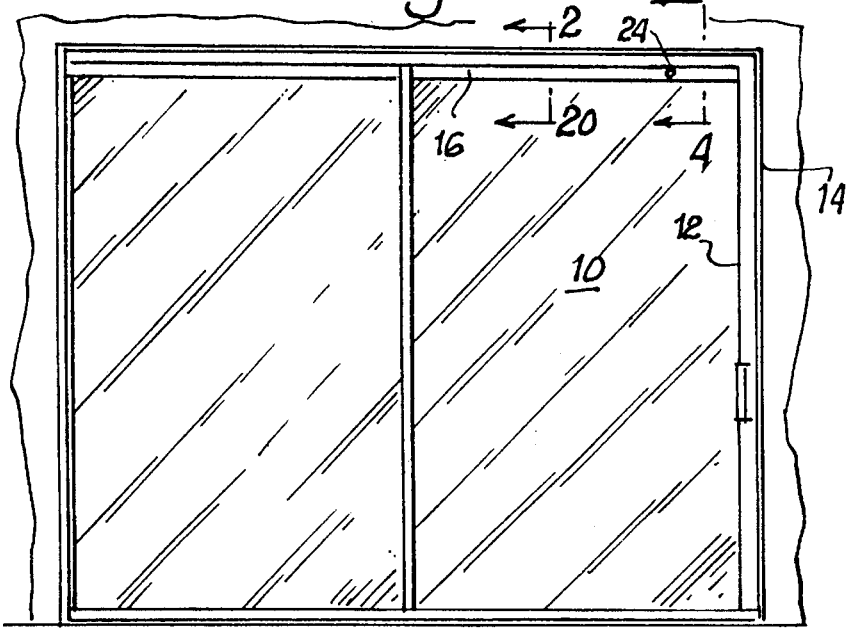
FIG. 1 is a front elevation view of a slide glass door illustrating the location of the magnetic insert.
Figure 2:
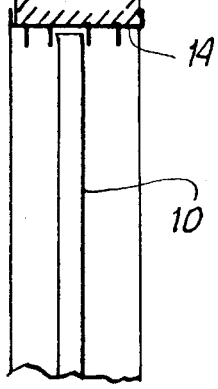
FIG. 2 is a section taken along line 2—2 of FIG. 1.
Figure 3:
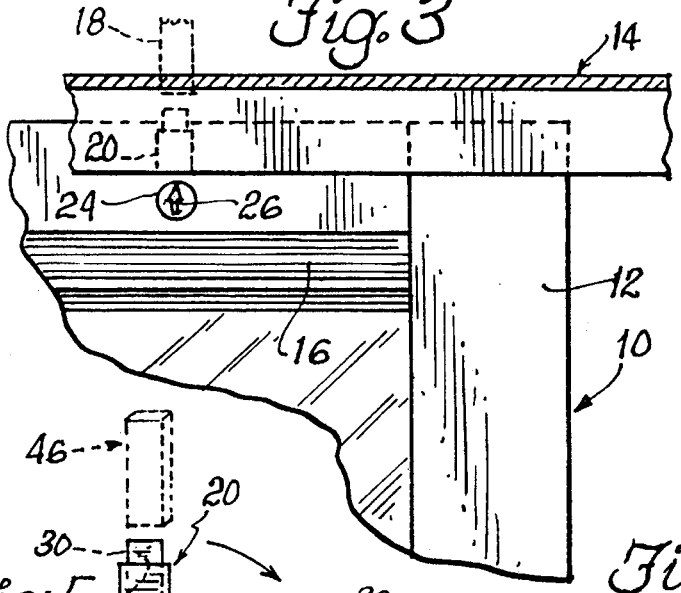
FIG. 3 is an elevation of a detail of the upper right corner of the sliding door illustrating the magnetic trip passing beneath the embedded magnetic reed switch in a completed installation.
Figure 4:
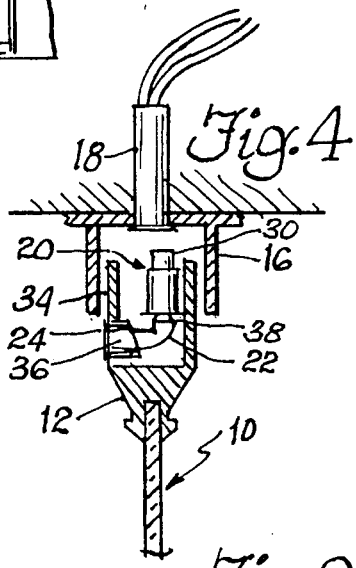
FIG. 4 is a section taken along line 4—4 of FIG. 1.

The environment of the invention is shown in FIG. 1 wherein a typical sliding glass door 10 with a peripheral frame 12 slides in the door casing 14. As best seen in FIG. 4, above the top 16 of the casing 14 is an inserted dowel-shaped magnetic reed switch 18 which connects to the rest of the alarm system. Because the switch must be wired, it is ordinarily installed first, wired in series with the other switches and the magnetic trip is then installed in the sliding door just beneath the switch so that when the door is closed, the normally open (that is, when the trip is not present) switch is closed. The switches can also be wired in parallel and separately connected to a central console which will also be able to identify which of the entry points had been breached in the event the alarm is actuated. Either way, the point in time that must be identified to the alarm system is the time when the door moves from the closed position to a non-closed position, which is accomplished by aligning the trip and the switch when the door is closed, irrespective of whether the switch is normally open or normally closed.

The peripheral door frame 12 shown in section in FIG. 4 is not accessible without removing the glass and dismantling the door substantially in its entirety. However, just enough access is created to position the trip element where it is operative with the reed switch.

The trip element or insert 20 is molded in plastic in its preferred embodiment. The L-shaped plastic body has two substantially orthogonal legs defined by a stem 22 and a magnet 32, respectively. The stem is characterized by having a thin cap 24 which extends laterally just beyond the perimeter of the stem and displays an orientation arrow 26, the central portion of which is a slot 28 which permits rotation of the element with a screw driver. Just beyond the stem, the trip element contracts to a reduced diameter to define a breakaway portion. Beyond the breakaway portion it expands again into a hollow seat which seats the magnet element 30. The magnet would ordinarily be molded into the plastic in the molded process, but it could also be slipped into a pre-defined socket. Although it is securely engaged in the plastic through the molding process, it is removable as described below.

The insert is mounted as follows. A ⅜ inch hole is bored into the side wall 34 of the peripheral door frame at the place which positions the magnet adjacent the switch 18 in the sliding direction when the door. Vertical positioning is such that when the element is completely inserted the magnet just clears the bottom of the installed magnetic switch. Once the hole has been marked and drilled, the trip element is pressed magnetic-end-first through the opening and rotated with the magnet moving upwardly to the upright position at which point the installer pushes on the stem end, which frictionally engages the hole by virtue of compressible side structure such as the ribs 36. As it fully enters the hole, the cap 24 presses up against the sidewall surface, making a neat sealed appearance that is not readily discernable as a magnetic trigger mounting hole. In fact, there is no way of knowing what the little circle is once it is installed. The frictional fit of the stem with the hole supports the magnet upright without further adhesives or other structure. It is unlikely that the insert would ever loosen, but if the mounting hole were cut oversized, for example, and the trip were to fall away from the switch, the alarm would sound and the owner would be alerted, so the situation would not persist.

Figure 8:
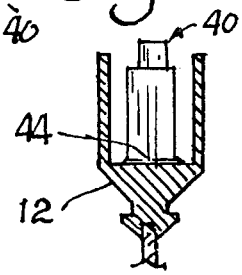
FIG. 8 is a transverse section taken through an old-style door with the typical plug mounted atop the frame; and, FIG. 9 is a transverse cross-section through a narrow frame window having a bare bar magnet element sandwiched between the side walls of the peripheral frame.

As mentioned above, the insert has a narrow waist portion 38, which can be easily snapped by the workman to produce a broken-off plug 40 that houses the magnet 30 inside the remaining plastic shell 42. In this configuration, the magnet portion of the insert can be mounted in an old-style sliding glass door illustrated in FIG. 8. The flat bottom portion of the magnet element with the surrounding plastic is pressed onto a glue patch 44, and that's all there is to the installation. Again, the door of FIG. 8 is the old style which is easily removed from its track, permitting this type of mounting.

Figure 5:
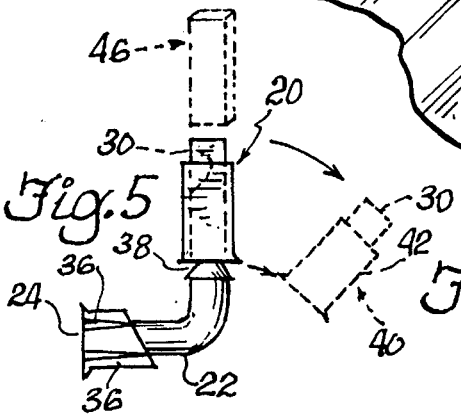
FIG. 5 is a perspective view illustrating the breakaway version of the invention in its three different use modes.
Figure 9:
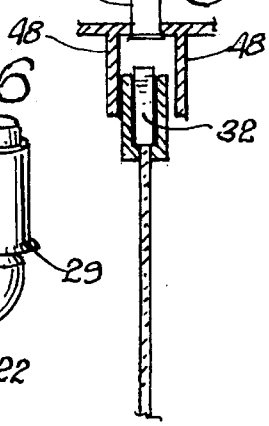
Figure 7:
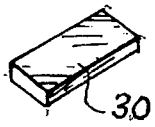
FIG. 7 is a perspective view of a typical flat bar magnet.

As shown in FIG. 5, in addition to the break away mode shown in phantom, the magnet can be removed entirely from the plastic as indicated at 46. This is helpful when encountering certain narrow-flamed sliding windows such as the one indicated in FIG. 8. The side walls 48 are so close together that only an ⅛- inch wide magnet can slip between them, which is done with the magnet 32 of FIG. 7 as shown in FIG. 9. The magnet is pulled out of its plastic jacket and slipped between the narrow glue-lined walls of the window frame. These thin magnets are often difficult to find at the retail level, and running out of them in the middle of an installation can be quite aggravating.

The insert thus has three separate possible uses, but each unit can only be used in whatever mode is chosen. By obviating the three-part inventory requirement, significant time is saver by the installer. The chances of being stuck, unable to finish a job for want of a part, are significantly reduced.

The embodiment shown in FIG. 5 is a preferred embodiment, but is not the only way of making the trip. An almost identical modal, but with no narrowed waist and not designed to snap apart can be used as a one-mode product.

Figure 6:
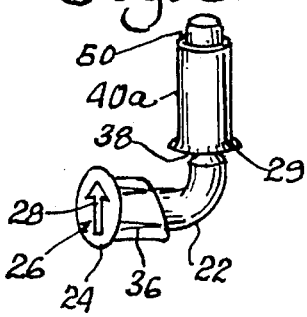
FIG. 6 is a perspective view of a modification of the invention wherein a cylindrical rather than rectangular magnet is used with the inherent difference in modes of use.

Yet another modification is shown in FIG. 6, which is identical to FIG. 5 except that the magnet element is cylindrical. The two are not functionally identical and interchangeable as might appear. Cylindrical magnets have a considerable cost advantage over rectangular magnets, but are not quite as powerful and therefore cannot be trusted in the sliding window application, so only the two sliding door modes are available for the cylindrical magnet version. However, yet another mode of use is possible with the cylindrical magnet. The broken-off plug or magnetic subassembly **40*a*can be used as a standard, straight-in installation into a circular hole. This is quite significant. It is estimated that half of all units sold would be used this way. The magnetic subassembly or plug 40*a* has a cap 29** of diameter just under that of the main stem so there will be no installation hangups. With a stem of ⅜ inch and main cap diameter of 7/16, the subassembly would have a 5/16 inch diameter with a 21/64 inch cap.

Having used the invention innumerable times in his own work, the inventor is confident that there will be a steady market for the device because it saves so much time in modern sliding glass door installations and does not alert the burglar to the location of the switch. If the location of a switch is known, a bar magnet can be placed along the door frame in the the region just below the switch, and the door can then be opened with a reasonable chance of alarm circumvention.

The invention is not intended to be limited to the examples shown in the drawings or the written description, The interpretation of the claims should be broad enough to cover substantially any similar non-linear insert to be used in concert with a magnetic switch, for installation in tight, inaccessible places.

I claim:

1. A switch trip for use primarily in a sliding glass door having a frame with sidewalls to trip a magnetic alarm switch mounted in the door casing above the door, comprising:

(a) a magnetic element;

(b) an elongated stem mounting said magnet such that it extends longitudinally from one end thereof, and, (c) said stem and said magnet substantially defining an L-shape with the width between the apex of the "L" and a line between the two ends thereof being no greater than on the order of the spacing between said sidewalls such that said trigger can be inserted into a hole bored in one of said sidewalls of said sliding glass door near the top thereof and hooked into place with said magnetic element extending upright with its top adjacent the surface of said door casing which mounts said alarm switch.

2. A switch trip according to claim 1 wherein said L-shaped trip is of centrally reduced diameter compared to the thickness of said stem and is contoured to permit same to rotate into the smallest thickness sliding door made for general use without binding in said hole.

3. A switch trip according to claim 2 wherein said trip has a weakened region intermediate the ends thereof to define a breakaway point such that the user can break the stem off from said magnetic element to use the magnetic element and that portion of rest of the trip still clinging to same as a free-standing substantially straight trip for gluing to the top of a sliding glass door between said sidewalls.

4. A switch trip according to claim 1 wherein said magnetic element is removable from the rest of said trip and comprises a monolithic magnet of thickness on the order of ⅛ inch to be used between sidewalls of a thin configuration sliding window.

5. A switch trip according to claim 1 wherein said stem defines compressible side structure to press-fit into said hole and a thin cap member on the distal said stem to prevent said trip from falling into the frame of a door between said sidewalls.

6. A method of installing a generally L-shaped magnetic trip having a stem leg and a magnetic leg, between the sidewalls of a door frame of the type not removable from the casing from outside the door when the door is closed, for use tripping a magnetic switch mounted in the door casing above the door, comprising, (a) ascertaining the location of said switch in said door casing by inspection;

(b) closing said door and ascertaining the region of the door that generally aligns with said switch when said door is closed;

(c) Boring a hole in the door frame approximately the diameter of said stem; and, (d) inserting said trip magnetic leg first into said hole and rotating same until the magnetic leg is generally upright and the trailing end of said stem is substantially flush with said door frame.

7. A method according to claim 6 wherein said stem has a trailing end with an arrow displayed thereon indicating which direction from the axis of said stem said magnetic leg extends and including the step of ensuring that said magnetic leg is upwardly directed when installed in said door by rotating said stem until said arrow points up.

8. A multimodule substantially L-shaped magnetic switch trip having multiple independent modes of use such that it can be used as is by insertion through a hole cut in a sidewall of a door, or broken in two pieces one of which comprises a magnet at least partially embedded in a plastic material, for use in a removable sliding door, comprising:

(a) a generally L-shaped member with a magnet leg defined in one end and a yielding stem at the other end; and, (b) a frangible neck between said ends for breaking said stem in two to use the portion embedding the magnet in a removable sliding door.

9. A switch trip according to claim 8 wherein said trip is molded in plastic with said magnet molded integrally with one end of said trip.

10. A switch trip according to claim 9 wherein said stem includes an end cap dimensioned to prevent insertion of said trip completely through a hole bored in a door frame and including an arrow displayed on said cap pointing in the direction radial from said stem in which said magnetic leg points.

11. A switch trip according to claim 10 wherein said magnetic leg is attached to the remainder of said trip by a frictional slip-fit defined around a magnet, and said magnet can be slipped free of said remainder for use between the sidewalls of a sliding window.

12. A switch trip according to claim 8 and including a third mode of use wherein the magnetic element is completely separated from the remaining trip structure for use as-is between closely spaced sidewalls of a thin-style sliding window which define a channel atop said sliding window, said magnet being removable from said remaining trip structure to effectuate said third mode and when so removed, being of thickness dimension small enough to fit between said sidewalls and rest in said channel.

13. A switch trip according to claim 8 wherein said magnet is cylindrical and both legs of said L-shaped member define hole plugs for frictionally interfitting a hole, one of said hole plugs seating said magnet and being of reduced diameter from the other of said hole plugs such that said one of said plugs can be inserted through a wall in which a hole large enough to hold said insert has been bored.

* * * * *